United States Patent [19]

Williams

[11] Patent Number: 4,779,899

[45] Date of Patent: Oct. 25, 1988

[54] ROOF DRAIN PRESSURE RING COMBINATION

[76] Inventor: Redford R. Williams, 1521 Woodhaven, Humboldt, Tenn. 38343

[21] Appl. No.: 110,176

[22] Filed: Oct. 19, 1987

[51] Int. Cl.[4] ..... F16L 55/12

[52] U.S. Cl. ..... 285/23; 285/42; 285/250; 285/321; 52/98

[58] Field of Search ..... 285/23, 260, 321, 42, 285/162, 222, 258, 42, 43, 44, 214, 397, 370, 379, 380; 52/98, 12, 15

[56] References Cited

U.S. PATENT DOCUMENTS

| | | | |
|---|---|---|---|
| 2,250,286 | 7/1941 | White | 285/321 X |
| 2,902,298 | 9/1959 | Kolthoff | 285/321 X |
| 3,323,846 | 6/1967 | Buddy | 285/321 X |
| 3,540,224 | 11/1970 | Poyonowski | 285/321 X |
| 3,958,313 | 5/1976 | Rossborough | 285/162 X |
| 4,082,321 | 4/1978 | Nakajima | 285/321 X |
| 4,469,467 | 9/1984 | Odill | 285/397 X |
| 4,685,704 | 8/1987 | Kolar | 285/397 X |

FOREIGN PATENT DOCUMENTS

| | | | |
|---|---|---|---|
| 917193 | 1/1963 | United Kingdom | 285/321 |

OTHER PUBLICATIONS

Buyline 2998, Duro-Lost Roofing, Inc., brochure 07500/Dar.

U-Flow Announces Retro Drain Bulletin No. UF4.

*Primary Examiner*—Dave W. Arola

*Attorney, Agent, or Firm*—Walker & McKenzie

[57] ABSTRACT

A pressure ring combination for sealing the inverted stack of a membrane roof to a waste pipe or other drainage member. The pressure ring combination includes a ring member that is movable between a contracted position and an expanded position, and a keeper member for keeping the ring member in the contracted position until it is desired to expand the ring member. The pressure ring combination can be easily inserted into the interior of the drainage member with a portion of the inverted stack positioned between the pressure ring combination and the interior of the waste pipe or other drainage member while the ring member is in the contracted position. The keeper member can then be removed from the ring member to allow the ring member to expand and to securely seal the portion of the inverted stack to the interior of the waste pipe or other drainage member.

7 Claims, 1 Drawing Sheet

ROOF DRAIN PRESSURE RING COMBINATION

BACKGROUND OF THE INVENTION

1. Field of the Invention:

The present invention relates, in general, to means for sealing membrane types of roofs to a waste pipe or other drainage member.

2. Description of the Related Art:

It is known in the art to seal membrane-type roofing material to waste pipes or other drainage members with an annular patch-like member referred to as an "inverted stack". The inner edge of the inverted stack is positioned within the interior of the waste pipe or other drainage member, and the outer edge thereof extends over the top of the waste pipe or other drainage member and is "welded" to the membrane. The inner end of the inverted stack may be secured within the interior of the waste pipe or other drainage member with a typical snap ring. See brochure 07500/DUR, BuyLine 2998 of Duro-Last Roofing, Inc., 525 Morley Drive, Saginaw, MI 48601.

A preliminary patentability search in class 285, subclasses 43 and 44, and class 269, subclasses 47, 48 and 48.1 disclosed the following patents: Dawkins, U.S. Pat. No. 1,901,634; O'Brien, U.S. Pat. No. 1,938,437; Hirshstein, U.S. Pat. No. 2,091,927; Kulp, U.S. Pat. No. 4,040,420; and Demler, Sr., U.S. Pat. No. 3,703,302. None of the above prior art or prior patents disclose or suggest the present invention.

SUMMARY OF THE INVENTION

The present invention is directed toward providing an improved means for sealing membrane types of roofs to a waste pipe or other drainage member. The concept of the present invention is to provide a pressure ring combination for sealing the inverted stack of a membrane roof to a waste pipe or other drainage member. The pressure ring combination includes a ring member that is movable between a contracted position and an expanded position and a keeper means for keeping the ring member in the contracted position until it is desired to expand the ring member. The pressure ring combination can be easily inserted into the interior of the drainage member with a portion of the inverted stack positioned between the pressure ring combination and the interior of the waste pipe or other drainage member while the ring member is in the contracted position. The keeper means can then be removed from the ring member to allow the ring member to expand and to securely seal the portion of the inverted stack to the interior of the waste pipe or other drainage member.

DESCRIPTION OF THE PREFERRED EMBODIMENT

Figure 1:
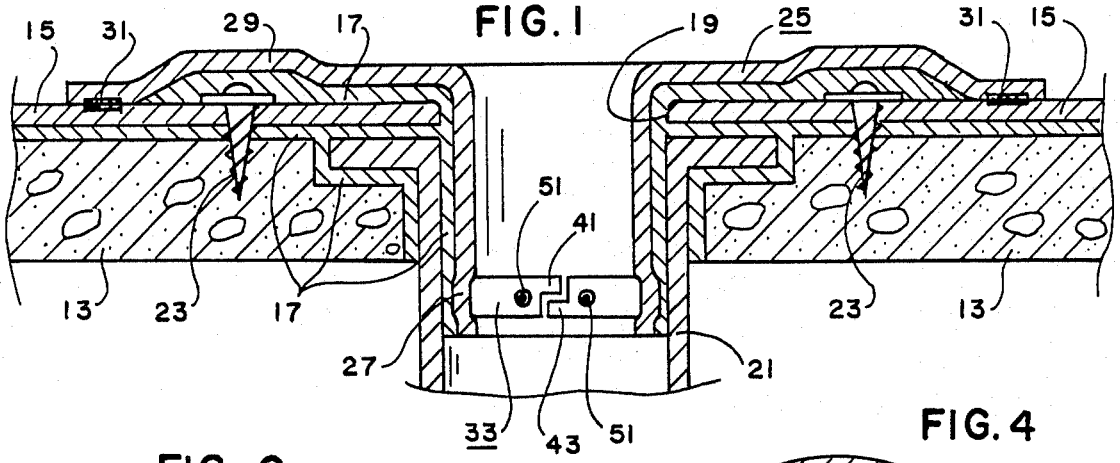
FIG. 1 is a somewhat diagrammatic sectional view showing the pressure ring of the present invention connecting an inverted stack of a membrane-type roof to the interior of a waste pipe.
Figure 2:
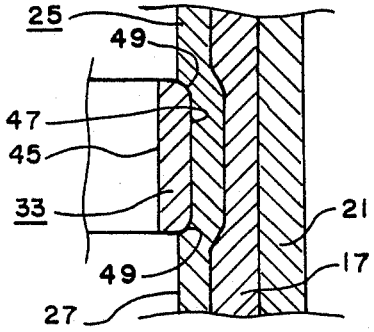
FIG. 2 is an enlarged sectional view of a portion of FIG. 1.

The preferred embodiment of the pressure ring combination 11 of the present invention is used with a membrane-type roof. More specifically, certain roof structures consist, in general, of a deck 13 made of concrete, or the like, with a sheet of membrane roofing material 15 covering the deck 13 and with an appropriate sealant 17 preferably provided between the deck 13 and the membrane roofing material 15. An aperture 19 is provided in the membrane roofing material 15 about the upper end of each waste pipe 21 or other drainage member which is attached to the deck 13. The membrane roofing material 15 is preferably secured to the deck 13 about the upper end of each waste pipe 21 with screw assemblies 23, or the like, as will now be apparent to those skilled in the art. An inverted stack 25 is placed over the aperture 19 with the distal end 27 thereof extending into the interior of the waste pipe 21 and with the skirt 29 thereof sealed to the membrane roofing material 15 by welds 31 as will be apparent to those skilled in the art. The sealant 17 may extend between the waste pipe 21 and the deck 13, between the distal end 27 of the inverted stack 25 and the interior of the waste pipe 21, and between the skirt 29 of the inverted stack 25 and the membrane roofing material 15 as will be apparent to those skilled in the art. Such membrane roofing material and inverted stacks can be obtained from, e.g., Duro-Last Roofing, Inc., 525 Morley Drive, Saginaw, MI 48601.

Figure 4:
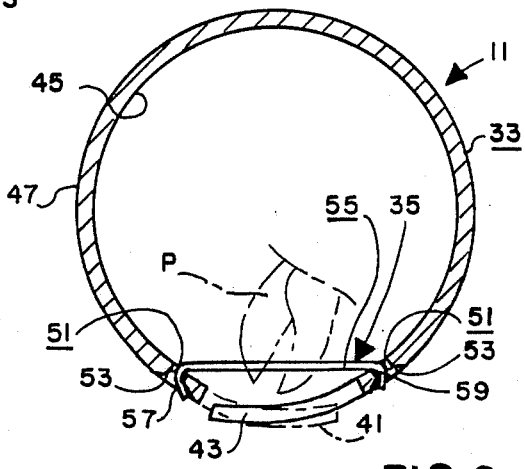
FIG. 4 is a somewhat diagrammatic sectional view as taken on line IV—IV of FIG. 3.
Figure 3:
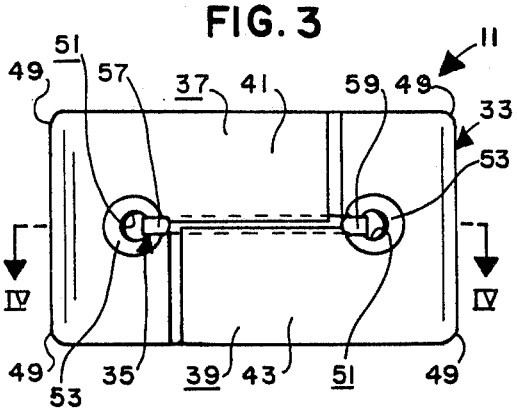
FIG. 3 is an elevational view of the pressure ring combination of the present invention.
Figure 6:
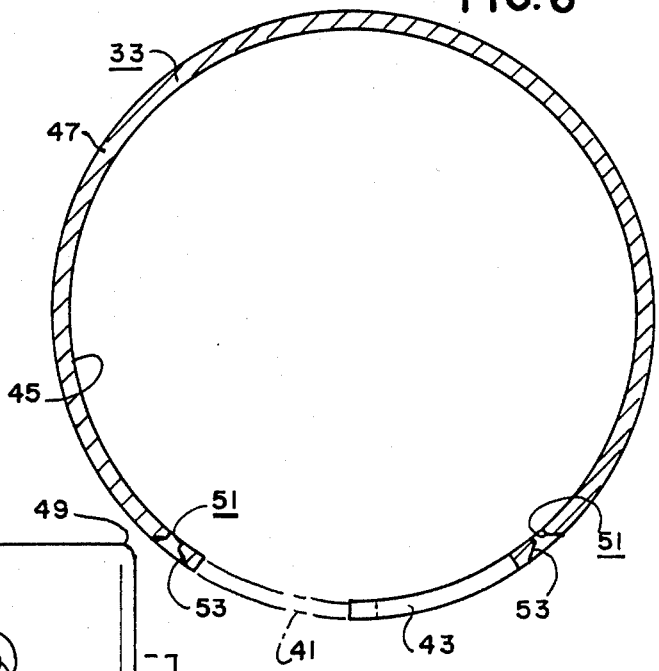
FIG. 6 is a somewhat diagrammatic sectional view as taken on line VI—VI of FIG. 5.
Figure 5:
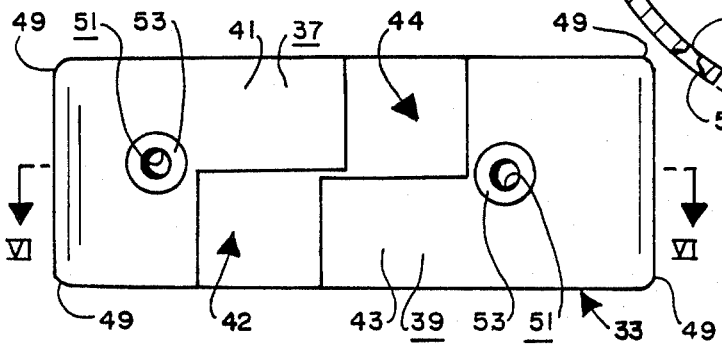
FIG. 5 is an elevational view of the pressure ring of the present invention.

The pressure ring combination 11 of the present invention is used to secure and seal the distal end 27 of the inverted stack 25 to the adjacent interior wall of the wate pipe 21. The pressure ring combination 11 includes a ring member 33 that is movable between a contracted position as shown in FIGS. 3 and 4 and an expanded position as shown in FIGS. 1, 2, 5 and 6 and includes a keeper means 35 for keeping the ring member 33 in the contracted position.

The ring member 33 is preferably constructed out of spring steel, or the like, so as to have an inherent resiliency to urge it from the contracted position toward the expanded position. The ring member 33 has a first end 37 and a second end 39. Each end 37, 39 of the ring member 33 is preferably off-set to allow the opposite ends 37, 39 to overlap one another as clearly shown in FIGS. 1, 3 and 5. More specifically, the end 37 of the ring member 33 preferably has an outwardly extending upper tab portion 41 created by a notch 42 in the end 39 as clearly shown in Fig. 5, and the end 39 of the ring member 33 preferably has an outwardly extending lower tab portion 43 created by a notch 44 in the end 39 as clearly shown in FIG. 5. At least a portion of each tab portion 41, 43 preferably overlaps at least a portion of the other tab portion 41, 43 when the ring member 33 is in both the contracted and expanded positions as clearly shown in FIGS. 1, 3 and 5. The ring member 33 has an inner side 45 and an outer side 47. At least the edges of the ring member 33 bordering the outer side 47 thereof are preferably rounded as at 49. An aperture 51 is provided through the ring member 33 substantially adjacent each end 37, 39 thereof. Each aperture 51 preferably has an enlarged portion 53 at the outer side 47 of the ring member 33. The specific construction and manufacture of the ring member 33 may vary as will now be apparent to those skilled in the art. Thus, the ring member 33 is preferably constructed out of 1½ inch wide, 304 grade stainless spring steel of 14 to 20 gauge. The specific preferred gauge depends on the desired diameter of the ring member 33. Thus, a ring member 33 sized to fit a 2 inch internal diameter wastepipe 21 is preferably constructed out of 20 gauge steel while a ring member 33 sized to fit a 3 inch internal diameter wastepipe 21 is preferably constructed out of 16 gauge stainless steel, while a ring member 33 sized to fit a 4 inch internal diameter wastepipe 21 is preferably constructed out of 14 gauge stainless steel, and while a ring member 33 sized to fit a 5 inch internal diameter wastepipe 21 is preferably constructed out of 12 gauge stainless steel.

The specific steps for manufacturing the ring member 33 may vary as will now be apparent to those skilled in the art. Thus, the ring member 33 is preferably constructed from a flat strip of stainless steel cut to proper length with rounded edges 49 on at least one side thereof. Next, the apertures 51 may be punched into the opposite ends thereof and the enlarged portions 53 may be countersunk thereinto. The tab portions 41, 43 may be formed in the opposite ends 37, 39 by cutting the notches 42, 44 thereinto. The edges of the tab portions 41, 43 are preferably rounded by being manually filed, etc. A typical rolling machine, or the like, may then be used to form an initial bend into the strip, and the bent strip is then inserted into a circular jig, or the like, and an expandable mandrel, or the like, is inserted into the bent strip and expanded to cause the bent strip to be permanently urged into a circular shape with the rounded edges 49 on the outer side thereof in a manner as will now be apparent to those skilled in the art.

The keeper means 35 preferably consists of a strap member 55 having a hook-like first end 57 for extending into the aperture 51 in the first end 37 of the ring member 33 with the distal end of the first end 57 located in the enlarged portion 53 and a hook-like second end 59 for extending into the aperture 51 in the second end 39 of the ring member 33 with the distal end of the second end 59 located in the enlarged portion 53. The strap member 55 may consist simply of a standard large, metal packing staple or the like of any specific construction now apparent to those skilled in the art.

To combine the ring member 33 and keeper member 35, the ring member 33 is merely compressed or otherwise moved to the compressed or retracted position and the ends 57, 59 of the strap member 55 inserted into the apertures 51 as shown in Figs., 3 and 4. The combination 11 can then be shipped and/or stored until it is desired to seal membrane roofing material 15 about a waste pipe 21 or the like. To use this combination 11, the distal end 27 of an inverted stack 25 is merely inserted into the interior of the waste pipe 21, or the like, in the typical manner preferably with sealant 17 located between the distal end 27 and the waste pipe 21. The combination 11 can then be picked up with a pair of typical side cutter wire pliers P, or the like, (shown diagrammatically by broken lines in FIG. 4) by attaching the pliers P to the strap member 55. The pliers P are then used to position the combination 11 within the interior of the waste pipe 21, or the like, with a portion of the inverted stack 25 located between the interior of the waste pipe 21 and the ring member 33. The strap member 55 is then cut with the pliers P to allow the ring member 33 to move to the expanded position and clamp the distal end 27 of the inverted stack 25 to the interior of the waste pipe 21.

As thus constructed and used, the present invention provides a pressure ring combination which can be easily inserted into the interior of a waste pipe or other drainage member with a portion of an inverted stack or the like positioned between the pressure ring combination and the interior of the waste pipe or other drainage member, which can be released so as to securely seal the portion of the membrane member to the interior of the waste pipe or other drainage member, and which will maintain proper pressure without damage to the inverted stack or the waste pipe, etc., as the elements contract and expand with temperature variances. By locating the distal ends of the first and second ends 57, 59 of the strap member 55 within the enlarged portions 53 of the apertures 51 and by rounding the edges 49 of the ring member 35, the chance of tearing the inverted stack 25 as the combination 11 is inserted thereinto, as the keeper means 35 is removed from the ring member 33 and the ring member 33 moves to the expanded position, and as the various elements expand and contract with change in temperature, etc., is reduced as will now be apparent to those skilled in the art. The seal provided by the ring member 33 is enhanced by the overlapping of at least a portion of the tab portions 41, 43 even when the ring member 33 is in the expanded position as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A pressure ring combination for sealing the inverted stack of a membrane to the interior of a drainage member, said combination comprising:

(a) a self-expanding ring member movable between a contracted position for allowing said pressure ring to be easily positioned within said interior of said drainage member and an expanded position for pressing said inverted stack against said interior of said drainage member to seal said inverted stack to said interior of said drainage member, said ring member having first and second ends; and (b) keeper means coupled to said ring member for keeping said ring member in said contracted position, said keeper means including a strap member having a first end for being removably coupled to said first end for said ring member and having a second end for being removably coupled to said second end of said ring member.

2. The combination of claim 1 in which said ring member has a first end and a second end that overlap one another when said ring member is in said contracted and expanded positions.

3. The combination of claim 2 in which said first end of said ring member has an outwardly extending upper tab portion created by a notch therein, and said second end of said ring member has an outwardly extending lower tab portion created by a notch therein with at least a portion of each of said tab portions overlapping at least a portion of the other of said tab portions when said ring member is in said the contracted and expanded positions.

4. A pressure ring combination for sealing the inverted stack of a membrane roof to the interior of a drainage member, said combination comprising:

(a) a self-expanding ring member movable between a contracted position of allowing said pressure ring combination to be easily positioned within said interior of said drainage member and an expanded position for pressing said inverted stack against said interior of said drainage member to seal said inverted stack to said interior of said drainage member; said ring member having a first end and a second end that overlap one another when said ring member is in said contracted and expanded positions: said ring member having an inner side directed toward the center of said ring member and an outer side for engaging said inverted stack when said ring member is positioned within said interior of said drainage member and is in said expanded position with the edges thereof bordering said outer side being rounded; and (b) keeper means coupled to said ring member for keeping said riing member in said contracted position.

5. A pressure ring combination for sealing the inverted stack of a membrane roof to the interior of a drainage member, said combination comprising (a) a self-expanding ring member movable between a contracted position for allowing said pressure ring to be easily positioned within said interior of said drainage member and an expanded position for pressing said inverted stack against said interior of said drainage member to seal said inverted stack to said interior of said drainage member; said ring member having a first end and a second end that overlap one another when said ring member is in said contracted and expanded positions: said ring member having a first aperture therethrough adjacent said first end thereof and having a second aperture therethrough adjacent said second end thereof; and (b) keeper means coupled to said ring member for keeping said ring member in said contracted position said keeper means including a strap member having a first end for being coupled to said first aperture of said ring member and has a second end for being coupled to said second aperture of said ring member.

6. The combination of claim 5 in which said first and second apertures through said ring member have an enlarged portion at said outer side of said ring member, and in which the distal end of said first and second ends of said strap member are positioned within said enlarged portion of the respective one of said first and second apertures through said ring member.

7. The combination of claim 6 in which said ring member is allowed to move to said expanded position by cutting said strap member.

* * * * *